US010125567B2

(12) United States Patent
Martin et al.

(10) Patent No.: US 10,125,567 B2
(45) Date of Patent: Nov. 13, 2018

(54) PACKER

(71) Applicant: SCHLUMBERGER TECHNOLOGY CORPORATION, Sugar Land, TX (US)

(72) Inventors: David Glen Martin, Keith (GB); Peter Wood, Aberdeen (GB); William Luke McElligott, Exeter (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 110 days.

(21) Appl. No.: 14/869,003

(22) Filed: Sep. 29, 2015

(65) Prior Publication Data

US 2016/0102522 A1 Apr. 14, 2016

(30) Foreign Application Priority Data

Oct. 8, 2014 (GB) ..... 1417841.2

(51) Int. Cl.
*E21B 33/129* (2006.01)
*E21B 33/127* (2006.01)
(Continued)

(52) U.S. Cl.
CPC ..... *E21B 33/1292* (2013.01); *E21B 33/127* (2013.01); *E21B 33/1212* (2013.01)

(58) Field of Classification Search
None
See application file for complete search history.

(56) References Cited

U.S. PATENT DOCUMENTS 2,084,611 A 6/1937 Crickmer
2,598,340 A 5/1952 Baker et al.
(Continued)

FOREIGN PATENT DOCUMENTS

GB 2398312 A 8/2004
GB 2526596 A 12/2015
(Continued)

OTHER PUBLICATIONS

International Search Report and Written Opinion for corresponding PCT Application Serial No. PCT/GB2015/052914, dated Feb. 9, 2016, 9 pages.
(Continued)

*Primary Examiner* — Matthew R Buck
*Assistant Examiner* — Douglas S Wood

(57) ABSTRACT

A morphable packer and method of setting the packer in a wellbore. The packer is a tubular member having a throughbore with a central portion having a greater diameter than each end portion with tapered portions there between. Gripping elements are arranged on the tapered portions. Morphing of the tubular member creates a seal between the central portion and an outer cylindrical structure, such as a wellbore or casing, and the gripping elements are moved radially outwards to engage with the cylindrical structure. The gripping elements act as slips which are activated by morphing the tubular member. Embodiments are described with the tubular member being a sleeve on a base pipe and, additionally, sealing and securing features in the form of elastomeric bands, lugs and wedges.

20 Claims, 3 Drawing Sheets

(51) Int. Cl.

| | |
|---|---|
| ***E21B 34/06*** | (2006.01) |
| ***E21B 43/10*** | (2006.01) |
| ***E21B 33/12*** | (2006.01) |

(56) References Cited

U.S. PATENT DOCUMENTS

| | | | | |
|---|---|---|---|---|
| 7,017,670 | B2 | 3/2006 | Hazel et al. | |
| 7,306,033 | B2 | 12/2007 | Gorrara | |
| 8,186,685 | B2 * | 5/2012 | Martin | E21B 17/07 277/334 |
| 2012/0125619 | A1 | 5/2012 | Wood et al. | |
| 2015/0345249 | A1 * | 12/2015 | Gorrara | E21B 33/127 166/387 |

FOREIGN PATENT DOCUMENTS

| | | | |
|---|---|---|---|
| WO | 2014006373 | A2 | 1/2014 |
| WO | 2016055775 | A1 | 4/2016 |

OTHER PUBLICATIONS

Combined Search and Examination Report for corresponding GB Application Serial No. GB1517604.3, dated May 4, 2016, 6 pages.
Examination Report for corresponding GB Application Serial No. GB1517604.3, dated Jan. 16, 2018, 4 pages.

* cited by examiner

PACKER

The present invention relates to an apparatus and method for securing a tubular within another tubular or borehole, and creating a seal across an annulus in a well bore. In particular, though not exclusively, the invention relates to a morphable packer which includes slips.

In the exploration and production of oil and gas wells, packers are typically used to isolate one section of a downhole annulus from another section of the downhole annulus. The annulus may be between tubular members, such as a liner, mandrel, production tubing and casing or between a tubular member, typically casing, and the wall of an open borehole. These packers are carried into the well on tubing and at the desired location, elastomeric seals are urged radially outwards or elastomeric bladders are inflated to cross the annulus and create a seal with the outer generally cylindrical structure i.e. another tubular member or the borehole wall. These elastomers have disadvantages, particularly when chemical injection techniques are used.

As a result, metal seals have been developed, where a tubular metal member is run in the well and at the desired location, an expander tool is run through the member. The expander tool typically has a forward cone with a body whose diameter is sized to the generally cylindrical structure so that the metal member is expanded to contact and seal against the cylindrical structure. These so-called expandables have an internal surface which, when expanded, is cylindrical and matches the profile of the expander tool. These expandables work well in creating seals between tubular members but can have problems in sealing against the irregular surface of an open borehole. Additionally, they cannot provide a portion of expansion to provide a packer as the expander tool must be drawn through the entire tubular metal member.

The present applicants have developed a technology where a portion of a tubular metal member is forced radially outwardly by the use of fluid pressure acting directly on the inside surface of the metal portion. Sufficient hydraulic fluid pressure is applied to move the metal portion outwards and cause the metal portion to morph itself onto the generally cylindrical structure. The metal portion undergoes plastic deformation and, if morphed to a cylindrical metal structure, the metal structure will undergo elastic deformation to expand by a small percentage as contact is made. When the pressure is released the metal structure returns to its original dimensions and will create a seal against the plastically deformed metal portion. During the morphing process, the inner surface of the metal portion will take up the shape of the surface of the wall of the cylindrical structure. This morphed tubular metal member is therefore ideally suited for creating a seal against an irregular borehole wall and for sealing an annulus over a desired length of the tubular metal member to act as a packer.

U.S. Pat. No. 7,017,670 to the present Applicant's discloses an apparatus for securing a tubular member within a liner or borehole which has a seal means connected within the tubular member, and a pressure control device operable to increase the pressure within the tubular member, such that operation of the pressure control means causes the tubular member to move radially outwardly to bear against the inner surface of the liner or borehole wall. Also, a packer for use in a downhole annular space and an isolation plug for plugging a downhole tubular are disclosed.

In an alternative arrangement, the morphed tubular metal portion is a sleeve mounted around a supporting tubular body, being fixed at each end of the sleeve to create a chamber between the inner surface of the sleeve and the outer surface of the body. A port is arranged through the body so that fluid can be pumped into the chamber from the throughbore of the body. In use, the pressure of fluid in the throughbore is increased sufficiently to enter the chamber and force the sleeve outwardly to morph to the generally cylindrical structure. Sufficient pressure has been applied when there is no return of fluid up the annulus which verifies that a seal has been achieved. The morphed sleeve is ideally suited as a packer or isolation barrier.

Such a morphed isolation barrier is disclosed in U.S. Pat. No. 7,306,033, which is incorporated herein by reference. An application of the morphed isolation barrier for FRAC operations is disclosed in US2012/0125619, which is incorporated herein by reference.

When a tubular member is morphed or expanded into another tubular, a large axial load may be placed on the connection. To assist in supporting this load, it is known to profile the outer surface of the tubular member such as by knurling to provide a larger contact area and improve the grip.

WO2014/006373 to the present Applicant's discloses the use of reinforcing annular members located on the outside of the liner which define expandable portion annular regions having differing resistance to the radial load whereby the regions having lower resistance expand prior to the regions having greater resistance when the expandable portion is subjected to radial outward expansion during morphing. In an embodiment, gripper elements are located in recesses between annular members. The gripper element comprises a ring formed from a plurality of gripping pads which are configured to resist axial and/or rotational movement of the liner by gripping an inner surface of the existing casing or liner. During application of fluid pressure to cause morphing, the gripper elements are forced radially outwardly against the inner surface of the outer tubular. Thus an anchor is effectively created by the gripping bands to assist in carrying the load of the liner while creating a metal to metal seal between the liner and the existing casing or liner.

In prior art packers, this gripping support is provided by slips which are metal wedges having teeth arranged on an outer surface which, when an axial load is applied forces the slips up a ramp so that they move outwards and contact the inner surface of the outer tubular. These are axial (mechanical) or hydraulic set.

It is an object of at least one embodiment of the present invention to provide an alternative morphable packer.

It is a further object of at least one embodiment of the present invention to provide a method for setting a morphable packer.

According to a first aspect of the present invention there is provided a morphable packer comprising:

a tubular member having a throughbore, the tubular member arranged to be run in and secured within a larger diameter generally cylindrical structure;

the tubular member having first and second end portions with a first outer diameter and a central portion with a second outer diameter being greater than the first outer diameter;

the tubular member being tapered between the central portion and the end portions providing first and second inclined surfaces;

first and second gripping elements, each gripping element having an upper surface including gripping means and a lower inclined surface arranged upon the first and second inclined surfaces, respectively;

wherein morphing of the tubular member creates a seal between the central portion and the cylindrical structure, and the gripping elements are moved radially outwards to engage with the cylindrical structure.

In this way, the gripping elements act as slips which are activated by morphing the tubular member. Thus a packer is formed having a morphed isolation barrier with anchoring in the form of slips.

Preferably, the gripping element comprises one or more sections, the one or more sections being arranged circumferentially around the expandable portion and having an outer surface including at least a portion adapted to grip. Advantageously, the gripping element comprises one section being a substantially annular member. The outer surface may comprise a plurality of circumferential ridges, the ridges providing a spike or tooth tip for gripping the inner surface of the existing casing. Other gripping arrangements, as are known in the art, may be applied to the surface of the gripper element. In this way, the known wedge shaped slips can be used in the present invention.

The large diameter structure may be an open hole borehole, a borehole lined with a casing or liner string which may be cemented in place downhole, or may be a pipeline within which another smaller diameter tubular section requires to be secured or centralised.

Alternatively or additionally, securing and sealing means can be provided on an outer surface of the central portion. The securing and sealing means could in certain embodiments be provided simply by the outer surface of the central portion. However, the securing and sealing means can preferably comprise a roughened part of the outer surface of the central portion to enhance the grip of the central portion on the existing tubular. At least part of an outer surface of the central portion can be coated with an elastomeric material to aid sealing. The securing or sealing means can comprise a profile applied to an outer surface of the central portion.

Additional elastomeric material preferably in the form of one or more elastomeric band(s) can be positioned along the length of the central portion. Preferably, the one or more elastomeric band(s) incorporate a fluid exclusion path that will ensure fluid is not trapped by the elastomer band(s). The higher coefficient of friction of the elastomer material of the one or more band(s) in contact with the metal will cause the load carrying capacity of the packer to be increased.

Preferably, first and second end bands are arranged around the tubular member adjacent the first and second gripping elements, the bands being of a metal which does not yield to morphing. In this way, the first and second end portions are prevented from morphing. More preferably, the bands have an inner face arranged perpendicularly to the outer surface of the tubular member arranged to abut a side wall of the adjacent gripping element. In this way, the gripping elements are prevented from moving laterally during morphing. Additionally, a portion of an inner surface of the band is tapered outwards towards the inner face of the band providing an initial circumferential void bounded by the outer surface of the tubular member, the tapered inner surface of the band and the side wall of the gripping element. In this way, the end portion of the tubular member can morph against the tapered inner surface so as to morph out the inclined surface of the tubular member to enhance the engagement of the gripping elements with the cylindrical structure.

Preferably, the tubular member has a uniform wall thickness. In this way, morphing will be uniform.

Preferably, at a first and/or second end of the central portion there is arranged a lug, the lug providing an overhang parallel to an outer surface of the central portion. Preferably, there is a lug at both the first and second ends. Preferably, the lug is arranged circumferentially around the outer surface of the central portion. In this way, after morphing, pressure in the annulus between the morphable packer and the cylindrical structure will enter the overhang and assist in forcing the lug against the cylindrical structure and improve the seal.

Advantageously, an outer surface of the lug includes spike, the spike gripping an inner surface of the cylindrical structure to improve contact and anchoring. The spike may be formed as a ring around the lug providing a line of point contact on the circumference of the lug. In this way, there is continuous point contact around each end of the central portion.

An outer elastomeric band may be arranged around the circumference of the lug on the outer surface. A resilient member may be located within the overhang. In this way, the resilient member fills the space between an outer surface of an end portion and an underside surface of the lug. The resilient member may be an elastomeric band, rubber band or other flexible material. The outer elastomeric band assists in the seal while the resilient member helps the initial energisation during morphing.

Preferably the gripping element includes a surface facing the central portion. More preferably, a wedge is arranged to abut the surface and may be connected thereto. Preferably a base of the wedge abuts the surface and an apex of the wedge lies below the overhang of the lug. In this way, when the tubular member is morphed, shrinkage which occurs along the length of the tubular member will cause the wedge to be pushed under the overhang and thereby force the lug outwards, improving its seal against the cylindrical surface.

In a first embodiment, the tubular member is part of a tubular string used within a wellbore, run into an open or cased oil, gas or water well. Where the tubular member is a casing or liner the present invention allows a casing section or liner to be centralised within a borehole or another downhole underground pipe. Additionally, the present invention can be used to isolate one section of the downhole annulus from another section of the downhole annulus and thus can also be used as a packer.

In a second embodiment the tubular member is a sleeve member, the sleeve being arranged around a base pipe and sealed thereto to create a chamber therebetween, and a port having a valve to permit the flow of fluid into the chamber provided through the base pipe in order to increase pressure within the chamber to cause the sleeve member to move outwardly and morph against the larger diameter generally cylindrical structure. The base pipe is preferably located coaxially within the sleeve and is part of a tubular string used within a wellbore, run into an open or cased oil, gas or water well. Therefore the present invention allows a casing section or liner to be centralised within a borehole or another downhole underground pipe by provision of a morphable sleeve member positioned around the casing or liner. Centralisation occurs as the sleeve will expand radially outwardly at a uniform rate with the application of pressure through the port. Additionally, the present invention can be used to isolate one section of the downhole annulus from another section of the downhole annulus and thus can also be used to isolate one or more sections of downhole annulus from the production conduit.

According to a second aspect of the present invention there is provided a method of setting morphable packer, comprising the steps:

(a) locating a morphable packer according to the first aspect on a tubular string;

(b) running the tubular string into a wellbore and positioning the morphable packer at a desired location within a larger diameter cylindrical structure;

(c) pumping fluid through the tubular string to cause the tubular member to move radially outwardly and morph against an inner surface of the larger diameter structure; and (d) using the morphing tubular member to move the gripping elements radially outwardly to engage the larger diameter structure.

In this way, the morphed tubular creates a packer within a wellbore.

The larger diameter structure may be an open hole borehole, a borehole lined with a casing or liner string which may be cemented in place downhole, or may be a pipeline within which another smaller diameter tubular section requires to be secured or centralised.

Step (c) may include the step of pumping fluid through a port in a base pipe to morph the tubular member as a sleeve upon the base pipe.

The method may include the step of allowing pressure in an annulus between the morphable packer and the larger diameter structure to enter an overhang of a lug on the morphable packer and energise the seal against the larger diameter structure. In this way, pressure is diverted from trying to penetrate between the packer and the larger diameter structure.

The method may further include the step of actuating a wedge to pass under the overhang of the lug on morphing. In this way the lug is permanently fixed against the larger diameter structure. In this way, when the morph pressure is released, the lugs are prevented from elastically relaxing back to their original position and thus maintain the seal between the morphable packer and the larger diameter structure.

The method may include the steps of running in a hydraulic fluid delivery tool, creating a temporary seal above and below the location of the gripping members to isolate a space and injecting fluid from the tool into the space to morph the tubular member.

In the description that follows, the drawings are not necessarily to scale. Certain features of the invention may be shown exaggerated in scale or in somewhat schematic form, and some details of conventional elements may not be shown in the interest of clarity and conciseness. It is to be fully recognized that the different teachings of the embodiments discussed below may be employed separately or in any suitable combination to produce the desired results.

Accordingly, the drawings and descriptions are to be regarded as illustrative in nature, and not as restrictive. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes.

All numerical values in this disclosure are understood as being modified by "about". All singular forms of elements, or any other components described herein including (without limitations) components of the apparatus are understood to include plural forms thereof.

Embodiments of the present invention will now be described, by way of example only, with reference to the accompanying drawings of which:

Figure 5A:
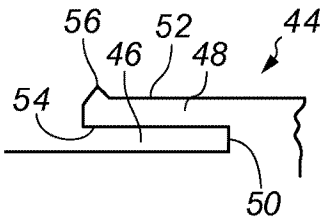
Figure 5B:
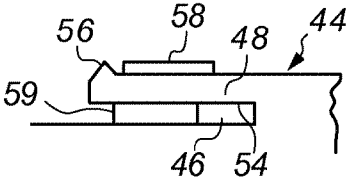
Figure 6:
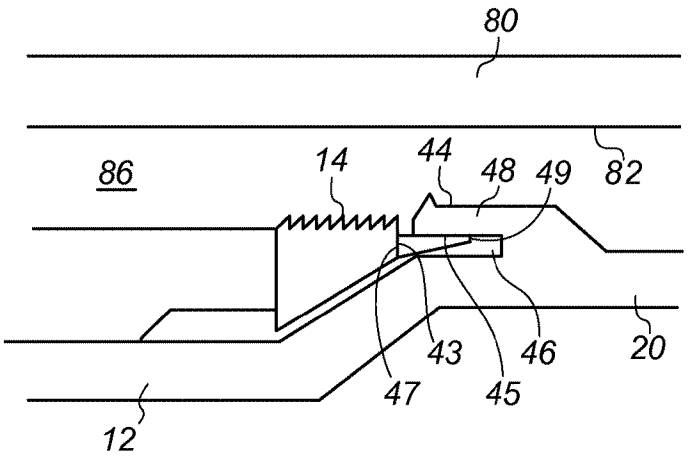

FIGS. 5(*a*) and 5(*b*) are cross-sectional views of embodiments of lugs for use on the morphable packer according to the present invention; and FIG. 6 is a cross-sectional view of an end portion of a morphable packer according to a yet further embodiment of the present invention.

Figure 1:
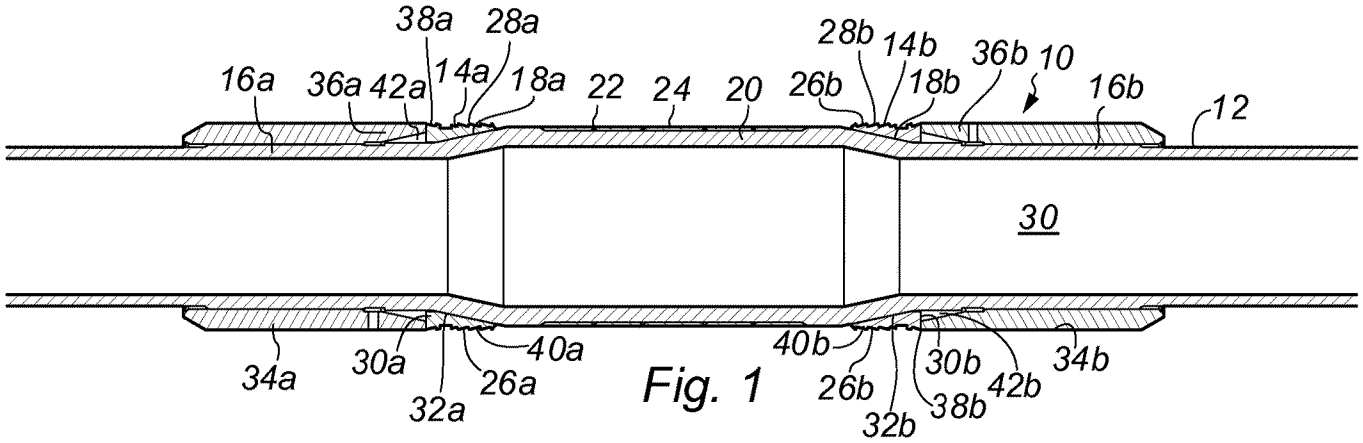
FIG. 1 is a cross-sectional view through a morphable packer according to an embodiment of the present invention.

Reference is initially made to FIG. 1 of the drawings which illustrates an morphable packer, generally indicated by reference numeral 10, including a tubular member 12 and gripping elements 14*a,b* according to an embodiment of the present invention.

Tubular member 12 is a cylindrical tubular section providing a tubular body having at a lower end (not shown), a box section and at an upper end (not shown), a pin section for connecting the member 12 into a tubing string such as casing, liner or production tubing that is intended to be permanently set or completed in a well bore. Member 12 includes a throughbore 30 which is co-linear with the throughbore of the string.

Tubular member 12 is a steel cylinder of uniform wall thickness being formed from typically 316L or Alloy 28 grade steel but could be any other suitable grade of steel or any other metal material or any other suitable material which undergoes elastic and plastic deformation. The tubular member 12 has a non-uniform outer diameter. A first end portion 16*a* has a first outer diameter. This first end portion 16*a* is then tapered outwards providing a first inclined outer surface 18*a* to meet a central portion 20 with a second outer diameter greater than the first outer diameter. A second inclined outer surface 18*b* is then provided by tapering of the member 12 to a second end portion 16*b* with an outer diameter matching the first outer diameter. In this way, the packer 10 has identical ends which are oppositely arranged on a central portion 20.

The central portion 20 has a non-uniform outer surface 22 such as ribbed, grooved or other keyed surface in order to increase the effectiveness of the seal created by the central portion 20 when secured within another casing section or borehole.

An elastomer 24 or other deformable material is bonded to the outer surface 22 of the central portion 20; this may be as a single coating but is preferably a multiple of bands with gaps therebetween as shown in the Figure. The bands or coating may have a profile or profiles machined into them. In this embodiment, the elastomer bands 24 are located in grooves machined on the outer surface so that they do not sit proud of the outer surface to provide protection during run-in. The elastomer bands 24 are spaced apart such that when the member 12 is being morphed the bands 24 will contact the inside surface 82 of an existing tubular 80 or open borehole first. The tubular member 12 will continue to expand outwards into the spaces between the bands 24, thereby causing a corrugated effect on the tubular member 12. These corrugations provide a great advantage in that they increase the stiffness of the tubular member 12 and increase its resistance to collapse forces.

The gripping elements 14*a,b* are formed as an annular ring which sits around the circumference of the inclined surface 18*a,b* of the tubular member 12. Each gripping element 14*a,b* is substantially an annular metal band of hardened material. The outer face 26*a,b* of the gripping elements 14*a,b* is profiled to provide a gripping surface 28*a,b*. In the embodiment shown the gripping surface 28*a,b* is formed by ridges machined circumferentially around the outer surface 26*a,b* of element 14*a,b* to provide toothed tips for engaging and holding on an inner surface of an existing tubular (not shown) or an open borehole. The gripping elements 14*a,b* are wedged shaped with a triangular cross-section. This arrangement provides a side wall 30*a,b* and an inner surface 32*a,b* which is angled to match the inclined surface 18*a,b*. The gripping element 14*a,b* is constructed as two or more arc portions of a circle which combine to form the gripping element 14*a,b*. The gripping element 14*a,b* then has a retaining ring (not shown) around the outer gripping surface 28*a,b* to hold the arc portions in place initially. On morphing the retaining ring snaps to allow the arc portions to move radially outwards. The gripping elements 14*a,b* will be recognised by those skilled in the art as standard slips as used in prior art packers.

End bands 34*a,b* are arranged on each end portion 16*a,b*. Each end band 34*a,b* is a cylindrical steel sleeve which fits over the tubular member 12 and is affixed thereto. The end bands 34*a,b* are formed of a higher gauge steel than the tubular member 12, the gauge being sufficient to be unaffected by morphing. Thus the end bands 34*a,b* are static and prevent the end portions 16*a,b* at the end bands 34*a,b* from being able to move during morphing. A portion 36*a,b* at a first end 38*a,b* of each end band 34*a,b* is also tapered to provide a further inclined surface 40*a,b*. This further inclined surface 40*a,b* together with the side wall 30*a,b* and the outer surface 22 of the end portion 16*a,b* provides a void 42 when the packer 10 is assembled.

Packer 10 is assembled by arranging the gripping elements 14*a,b* onto the inclined surfaces 18*a,b*. The end bands 34*a,b* are slid over the tubular member 12*a,b* and are fixed to the member 12*a,b* to hold the gripping elements 14*a,b* in position.

Figure 2:
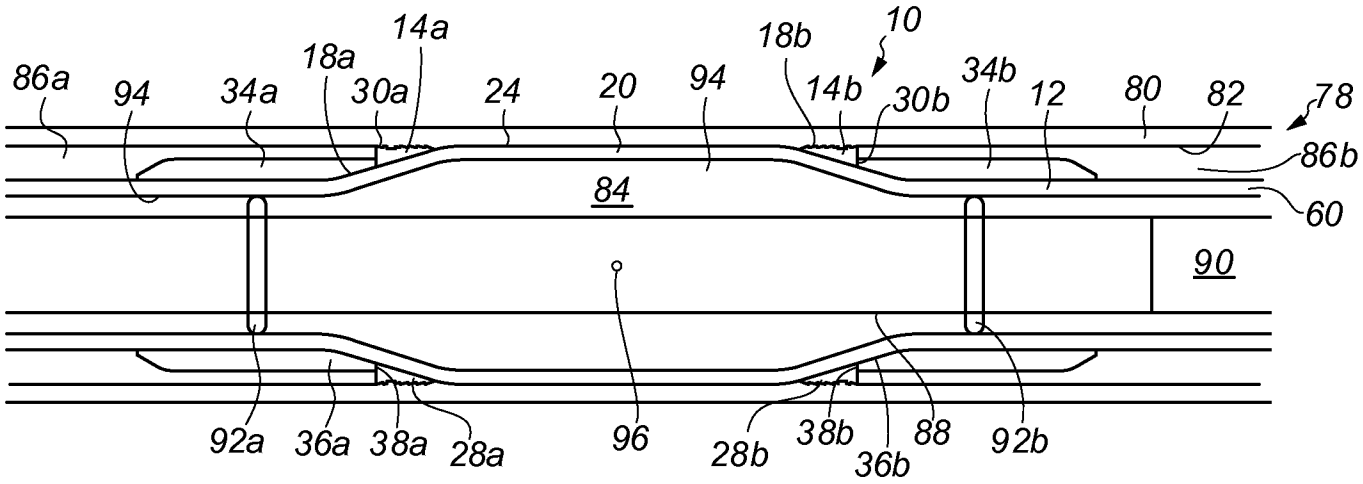
FIG. 2 is a cross-sectional view through a morphable packer according to a further embodiment of the present invention.

Reference will now be made to FIG. 2 of the drawings which provides an illustration of the morphable packer 10 once set and is used to describe a method for setting a morphable barrier within a well bore according to an embodiment of the present invention. Like parts to those in the earlier Figure have been given the same reference numerals to aid clarity.

In use, the packer 10 is conveyed into the borehole by any suitable means, such as incorporating the packer 10 into a casing or liner string 60 and running the string 60 into a wellbore 78 until it reaches the location within a casing 80 at which operation of the packer 10 is intended. This location is normally within the borehole at a position where the packer 10 is required in order to, for example, isolate the annulus 86 between the string containing the tubular member 12 and an outer casing 80, into an annular zone 86*a* located above the packer 10 from that below 80*b*. Alternatively, the position may be a desired location for which another tool on the string 60 requires to be positioned and the packer 10 will anchor the string 60 in position.

A hydraulic fluid delivery tool 88 is used to set the morphed packer. Once the string 60 reaches its intended location, tool 88 can be run into the string 60 from surface by means of a coiled tubing 90 or other suitable method. The tool 88 is provided with upper and lower seal means 92*a,b*, which are operable to radially expand to seal against the inner surface 94 of the tubular member 12 at a pair of spaced apart locations in order to isolate an internal portion 84 of the tubular member 12 located between the seals 92*a,b*. The seal assemblies 92*a,b* are positioned at the end bands 34*a,b*. Tool 88 is also provided with an aperture 96 in fluid communication with the interior of the string 60.

To operate the tool 88, seal means 92*a,b* are actuated from the surface to isolate the portion of the tubular member 12. Fluid, which is preferably hydraulic fluid, is then pumped under pressure, through the coiled tubing such that the pressurised fluid flows through tool aperture 96 and into the space 84. As space 84 is sealed and of fixed volume, the consequent increase in pressure of fluid in space 84 causes the fluid to act directly against the inner surface 94 of the tubular member 12. The fluid acts against the inner surface 94 at the inclined surfaces 18*a,b* and the central portion 20. The fluid pressure causes the tubular member 12 between the seal assemblies 92*a,b* to move radially outwardly.

The central portion 20 is morphed against the inner surface 82 of the casing 80 and seals against a portion of the inner surface 82 of the casing 80. As described hereinbefore, the elastomer bands 24 will contact the inside surface 82 of the casing 80 first and then the tubular member 12 will continue to expand outwards into the spaces between the elastomer bands 24 to cause a corrugated effect on the tubular member 12 and provide multiple metal to metal seal points along the central portion 20.

The inclined surfaces 18*a,b* are also moved radially outwards and will force the gripping elements 14*a,b* radially outwards also. The tubular member 12 morphs into the voids 42*a,b* and, as the end bands 34*a,b* are unaffected by the pressure, it morphs against the tapered surface on the portion 36*a,b*. This movement causes the side wall 30*a,b* of the gripping element 14*a,b* to ride up the end 38*a,b* of the end band 34*a,b*. The end band 34*a,b* thus prevents lateral movement of the gripping element 14*a,b*. The gripping surface 28*a,b* on each gripping element 14*a,b* will engage with the inner surface 82 of the casing 80 to anchor the packer 10 to the casing 80.

The pressure on the tubular member 12 between the seal assemblies 92*a,b* continues to increase such that the tubular member 12 initially experiences elastic expansion followed by plastic deformation. The central portion 20 expands radially outwardly beyond its yield point, undergoing plastic deformation until the tubular member 12 morphs against the surface 82 of the casing 80 as shown in FIG. 2. The casing 80 will also undergo elastic deformation and expand by a small amount. When the pressure is bled off the casing will relax and return to it's original diameter and enhance the seal between the packer 10 and the casing 80. When the pressurised fluid is bled off, the seal assemblies 92*a,b* are deactivated and the tool 88 pulled out of the wellbore. Accordingly, the tubular member 12 has been plastically deformed and morphed by fluid pressure without any mechanical expansion means being required and the gripping elements have been activated by morphing without requiring being axial (mechanical) or hydraulic set.

A detailed description of the operation of a hydraulic fluid delivery tool 88 is described in GB2398312 in relation to the packer tool 112 shown in FIG. 27 with suitable modifications thereto, where the seal means 92*a,b* could be provided by suitably modified seal assemblies 214, 215 of GB2398312, the disclosure of which is incorporated herein by reference. The entire disclosure of GB2398312 is incorporated herein by reference.

Figure 3:
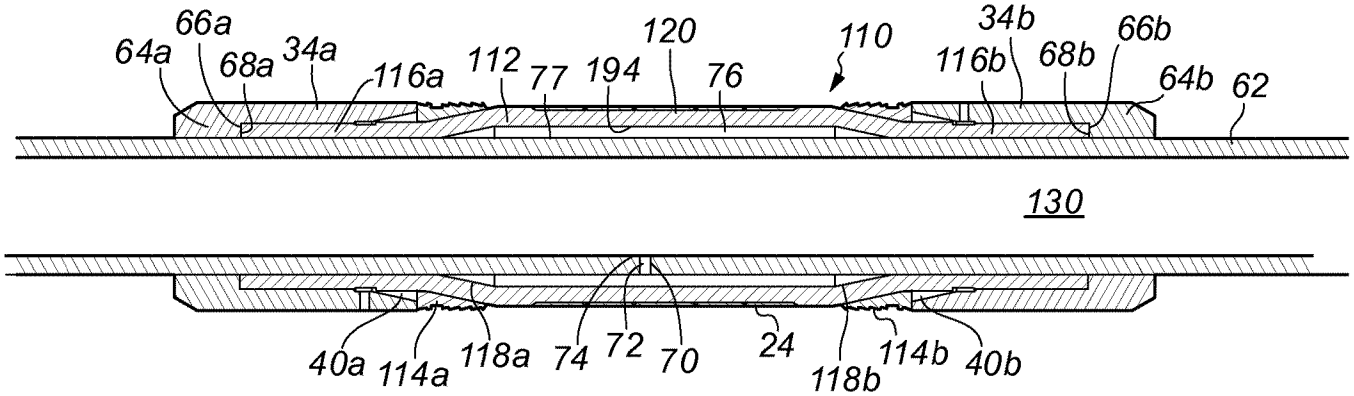
FIG. 3 is a cross-sectional view through the morphable packer of FIG. 1 when set according to an embodiment of the present invention.

Reference is now made to FIG. 3 of the drawings which illustrates a morphable packer, generally indicated by reference numeral 110, according to a further embodiment of the present invention. Like parts to those of the packer 10 of FIG. 1 have been given the same reference numeral with the addition of 100 to aid clarity.

The tubular member 112 of packer 110 is shortened and is mounted as a sleeve around a base pipe 62. The base pipe 62 is made of a higher gauge steel than the tubular member 112 so that it is not affected by fluid pressure. Due to the presence of the base pipe 62, the tubular member 112 may be thin-walled and of a substantially lower gauge to provide for an easier morph at lower pressures.

The end bands 134*a,b* have end stops 64*a,b* providing a face 66*a,b* at the ends 68*a,b* of the tubular member 112. The end bands 134*a,b* now cover the end portions 116*a,b* and are affixed to the base pipe 62. Base pipe 62 includes a port 70 through which fluid can flow. The port 70 has a check valve 72 and a rupture disk 74. The remaining parts of packer 110 are the same as and arranged identically to the packer 10.

In use, the packer 110 is conveyed into the borehole by any suitable means, such as incorporating the packer 110 into a casing or liner string by connecting the base pipe 62 in the string 60. Due to the presence of the rupture disk 74, fluids can flow through the bore 130 without risk of causing any undesired morphing. When the packer 110 is ready to be activated, fluid can be pumped under pressure through the bore 130 or the tool 88 can be located in the bore 130 over the port 70.

When a calculated fluid pressure is applied at the port 70, the rupture disc 74 will burst. The check valve 72 is arranged to allow fluid from the throughbore 130 to enter a chamber 76 created by the inner surface 194 of the central portion 120, the inclined surfaces 118*a,b* and the outer surface 77 of the base pipe 62. This fluid will increase pressure in the chamber 76 so as to cause the tubular member 112 to morph in the same manner as described hereinbefore with reference to FIG. 2. When the morphing has been achieved, the check valve 72 will close and trap fluid within the chamber 76. In this way, the pressure on the inner surface 94 is maintained regardless of other interventions through the bore 130.

Figure 4:
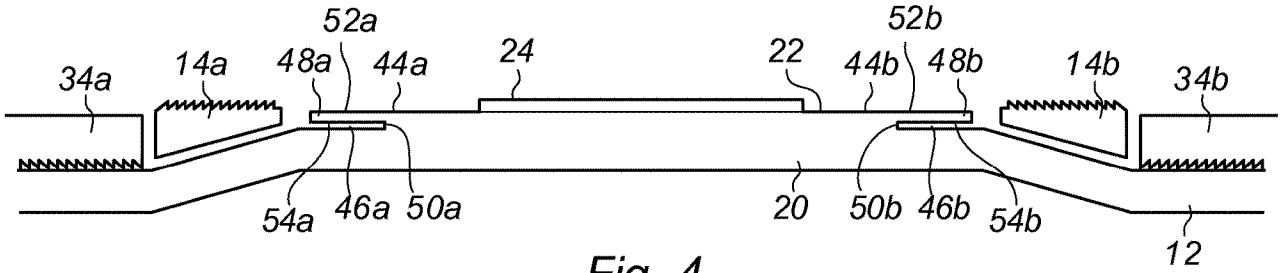
FIG. 4 is a cross-sectional view through a morphable packer according to a still further embodiment of the present invention.

Reference is now made to FIG. 4 of the drawings which illustrates a morphable packer 210, according to a further embodiment of the present invention. Morphable packer 210 is identical to morphable packer 10, with the exception of an additional set of lugs 44*a,b*. Like parts to those in FIG. 1 have therefore been given the same reference numerals to aid clarity.

At each end of the central portion 20, there are arranged oppositely directed lugs 44*a,b* upon the outer surface 22. Each lug 44*a,b* is formed by machining a slot 46*a,b* from an end, parallel to the outer surface 22.

The slot 46*a,b* creates an overhang 48*a,b* being an elongate member which will be resilient and have a degree of flex at the inner end 50*a,b* of the slot 46*a,b*. The slot 46*a,b* is preferably machined circumferentially around the tubular member 12, but may have keyed sections to provide a plurality of individual lugs around the circumference (not shown).

In use, the packer 210 is morphed as described with reference to FIG. 2. Following morphing the outer surface 52*a,b* of the lugs 44*a,b* will be in contact with the inner surface 82 of the casing 80. Fluid will exist in the annulus 86*a,b* and this can enter the slot 46*a,b*. Fluid pressure in the annulus 86*a,b* can act against the inner surface 54*a,b* of the overhang 48*a,b* and assist in maintaining the sealing contact with the inner surface 82 of the casing 80. Additionally, this pressure assists in preventing fluid passing between the outer surface 52*a,b* of the lugs 44*a,b* and the inner surface 82 of the casing which would otherwise act to break the seal between the packer 10 and casing 80.

When morphed, the gripping elements 14*a,b* will carry axial load. The elastomer 24 provides an outer seal against the casing 80. The lugs 44*a,b* give an energised seal due to their resilient nature and the flexing available at the point 50*a,b* under fluid pressure acting on the inner surface 54*a,b*.

Various designs of lugs 44*a,b* are available. FIG. 5(*a*) illustrates a lug 44, now with a point, stab or spike 56 on the outer surface 52. The spike 56 will grip the inner surface 82 of casing 80 to improve contact and anchoring. The spike 56 may be formed as a ring around the lug 44 providing a line of point contact on the circumference of the lug 44. In this way, there is continuous point contact around each end of the central portion 20.

In FIG. 5(*b*), the lug 44 is now also provided with an outer elastomeric band 58 is arranged around the circumference of the lug 44 on the outer surface 52. A resilient member 59 is located within the slot 46 under the overhang 48. The resilient member 59 extends across the slot 46. The resilient member 59 may be an elastomeric band, rubber band or other flexible material. The outer elastomeric band 58 assists in the seal while the resilient member 59 helps the initial energisation during morphing.

Referring now to FIG. 6 of the drawings, a further feature is illustrated to assist in maintaining the lug 44 in sealing contact with the inner surface 82 of the casing 80. A wedge 45 is arranged to abut an end surface 47 of the gripping element 14 which faces the central portion 20. A base 43 of the wedge 45 abuts the surface 47 and an apex 49 of the wedge 45 lies in the slot 46 below the overhang 48 of the lug 44. It is known that during morphing the packer 10 body shrinks a little as it expands. The gripping elements 14 will move inwards slightly. This movement energises the wedges 45 to move into the slots 46 and so force the overhangs 48 against the inside surface 82 of the casing 80. The wedge 45 will hold the overhang 48 in place and maintain sealing contact.

The principle advantage of the present invention is that it provides a morphable packer in which slips are activated by morphing.

A further advantage of the present invention is that it provides a method for setting a permanent packer which is entirely activated by morphing.

A yet further advantage of at least one embodiment of the present invention is that it provides a morphable packer which can be set by a lower pressure when the packer is mounted on a base pipe.

It will be apparent to those skilled in the art that modifications may be made to the invention herein described without departing from the scope thereof. For example, the inclined surfaces may be keyed so that the slips are further prevented from lateral movement during morphing. The central portion and the inclined surfaces may be thinner walled than the remainder of the tubular member to make morphing easier and provide ends with standard dimensions of pipe, liner or casing for connection in the string.

The invention claimed is:

1. A morphable packer comprising:

a tubular member having a throughbore, the tubular member arranged to be run in and secured within a larger diameter generally cylindrical structure;

the tubular member having first and second end portions with a first outer diameter and a central portion with a second outer diameter being greater than the first outer diameter;

the tubular member being tapered between the central portion and the end portions providing first and second inclined surfaces joining the first and second outer diameters; and first and second gripping elements, each gripping element having an upper surface including gripping means and a lower inclined surface arranged upon the first and second inclined surfaces, respectively, wherein morphing of the tubular member radially outward by applying internal pressure thereto, so that the tubular member contacts the cylindrical structure, creates a seal between the central portion and the cylindrical structure, and the gripping elements are moved radially outwards to engage with an inner surface of the cylindrical structure, thereby anchoring said tubular member in place, wherein first and second end bands are arranged around the tubular member adjacent the first and second gripping elements, the bands being of a metal which does not yield to morphing, wherein the bands have an inner face arranged perpendicularly to the outer surface of the tubular member arranged to abut a side wall of the adjacent gripping element, and wherein a portion of an inner surface of each band is tapered outwards towards the inner face of the band providing an initial circumferential void bounded by the outer surface of the tubular member, the tapered inner surface of the band and the side wall of the gripping element.

2. A morphable packer according to claim 1 wherein at a first end and/or a second end of the central portion there is arranged a lug, the lug providing an overhang parallel to an outer surface of the central portion.

3. A morphable packer comprising:

a tubular member having a throughbore, the tubular member arranged to be run in and secured within a larger diameter generally cylindrical structure;

the tubular member having first and second end portions with a first outer diameter and a central portion with a second outer diameter being greater than the first outer diameter;

the tubular member being tapered between the central portion and the end portions providing first and second inclined surfaces joining the first and second outer diameters; and first and second gripping elements, each gripping element having an upper surface including gripping means and a lower inclined surface arranged upon the first and second inclined surfaces, respectively, wherein morphing of the tubular member radially outward by applying internal pressure thereto, so that the tubular member contacts the cylindrical structure, creates a seal between the central portion and the cylindrical structure, and the gripping elements are moved radially outwards to engage with an inner surface of the cylindrical structure, thereby anchoring said tubular member in place, wherein at a first end and/or a second end of the central portion there is arranged a lug, the lug providing an overhang parallel to an outer surface of the central portion, and wherein at least one gripping element includes an end surface facing the central portion, a wedge is arranged to abut the end surface of the gripping element with a base of the wedge and an apex of the wedge lies below the overhang of the lug.

4. A morphable packer according to claim 3 wherein the gripping element comprises one or more sections, the one or more sections being arranged circumferentially around the expandable portion and having an outer surface including at least a portion adapted to grip.

5. A morphable packer according to claim 4 wherein the gripping element comprises one section being a substantially annular member.

6. A morphable packer according claim 3 wherein one or more elastomeric band(s) are positioned along the length of the central portion.

7. A morphable packer according to claim 3 wherein first and second end bands are arranged around the tubular member adjacent the first and second gripping elements, the bands being of a metal which does not yield to morphing.

8. A morphable packer according to claim 7 wherein the bands have an inner face arranged perpendicularly to the outer surface of the tubular member arranged to abut a side wall of the adjacent gripping element.

9. A morphable packer according to claim 8 wherein a portion of an inner surface of each band is tapered outwards towards the inner face of the band providing an initial circumferential void bounded by the outer surface of the tubular member, the tapered inner surface of the band and the side wall of the gripping element.

10. A morphable packer according to claim 3 wherein the tubular member has a uniform wall thickness.

11. A morphable packer according to claim 3 wherein there is a lug at both the first end and the second end.

12. A morphable packer according to claim 3 wherein the lug is arranged circumferentially around the outer surface of the central portion.

13. A morphable packer according to claim 3 wherein an outer surface of the lug includes spike, the spike gripping an inner surface of the cylindrical structure to improve contact and anchoring.

14. A morphable packer according to claim 13 wherein the spike is formed as a ring around the lug providing a line of point contact on the circumference of the lug.

15. A morphable packer according to claim 3 wherein an outer elastomeric band is arranged around the circumference of the lug on the outer surface.

16. A morphable packer according to claim 3 wherein a resilient member is located within the overhang.

17. A morphable packer according to claim 16 wherein the resilient member is an elastomeric band.

18. A morphable packer according to claim 3 wherein the tubular member is a sleeve member, the sleeve being arranged around a base pipe and sealed thereto to create a chamber therebetween, and a port having a valve to permit the flow of fluid into the chamber provided through the base pipe in order to increase pressure within the chamber to cause the sleeve member to move outwardly and morph against the larger diameter generally cylindrical structure.

19. A morphable packer according to claim 18 wherein the base pipe is part of a tubular string used within a wellbore.

20. A method of setting a morphable packer, comprising:

locating a morphable packer on a tubular string, the morphable packer comprising a tubular member having a throughbore, the tubular member arranged to be run in and secured within a larger diameter generally cylindrical structure; the tubular member having first and second end portions with a first outer diameter and a central portion with a second outer diameter being greater than the first outer diameter; the tubular member being tapered between the central portion and the end portions providing first and second inclined surfaces joining the first and second outer diameters; and first and second gripping elements, each gripping element having an upper surface including gripping means and a lower inclined surface arranged upon the first and second inclined surfaces, respectively;

running the tubular string into a wellbore and positioning the morphable packer at a desired location within a larger diameter cylindrical structure;

pumping fluid through the tubular string to apply internal pressure to said tubular member and cause the tubular member to move radially outwardly and morph against an inner surface of the larger diameter structure; and using the morphing tubular member to move the gripping elements radially outwardly to engage an inner surface of the larger diameter structure, thereby anchoring said tubular member in place, wherein at a first end and/or a second end of the central portion there is arranged a lug, the lug providing an overhang parallel to an outer surface of the central portion, and wherein at least one gripping element includes an end surface facing the central portion, a wedge is arranged to abut the end surface of the gripping element with a base of the wedge, and an apex of the wedge lies below the overhang of the lug.

* * * * *